US006049909A

United States Patent [19]

Anderson

[11] Patent Number: 6,049,909

[45] Date of Patent: Apr. 18, 2000

[54] DISPOSABLE INFANT GARMENT

[76] Inventor: Nina May Anderson, 8609 Maple Ave., Hesperia, Calif. 92345

[21] Appl. No.: 09/128,613

[22] Filed: Aug. 3, 1998

[51] Int. Cl.[7] ..... A41D 11/00; A41B 13/10

[52] U.S. Cl. ..... 2/111; 2/75; 2/49.1

[58] Field of Search ..... 2/51, 49.1, 48, 2/111, 114, 106, 46, 49.4, 50, 52, 74, 75, 80, 104, 105

[56] References Cited

U.S. PATENT DOCUMENTS

| | | | |
|---|---|---|---|
| 2,299,232 | 10/1942 | Heyser | 2/49.1 |
| 2,620,475 | 12/1952 | Legg et al. | 2/49.1 |
| 2,668,294 | 2/1954 | Gilpin | 2/114 |
| 3,311,925 | 4/1967 | Lilla et al. | 2/111 |
| 4,113,911 | 9/1978 | LaFitte et al. | 428/284 |
| 4,304,006 | 12/1981 | Swart | 2/49.1 |
| 4,504,977 | 3/1985 | King et al. | 2/51 |
| 4,523,335 | 6/1985 | Scrivens | 2/51 |
| 4,737,995 | 4/1988 | Wiley | 2/51 |
| 4,783,854 | 11/1988 | Bjorklund | 2/51 |
| 5,001,784 | 3/1991 | Orlando, Jr. | 2/114 |

*Primary Examiner*—Amy B. Vanatta
*Attorney, Agent, or Firm*—Michael I Kroll

[57] ABSTRACT

A disposable infant garment (10) comprising a one piece body pattern portion (12) having fold lines (14), a neck opening (16) and a pair of armholes (18). A facility (20) is provided for fastening abutting edges (22) of the one piece body pattern portion (12) together after being placed onto a torso (24) of an infant (26) and folded into position along the fold lines (14).

7 Claims, 2 Drawing Sheets

Fig. 1
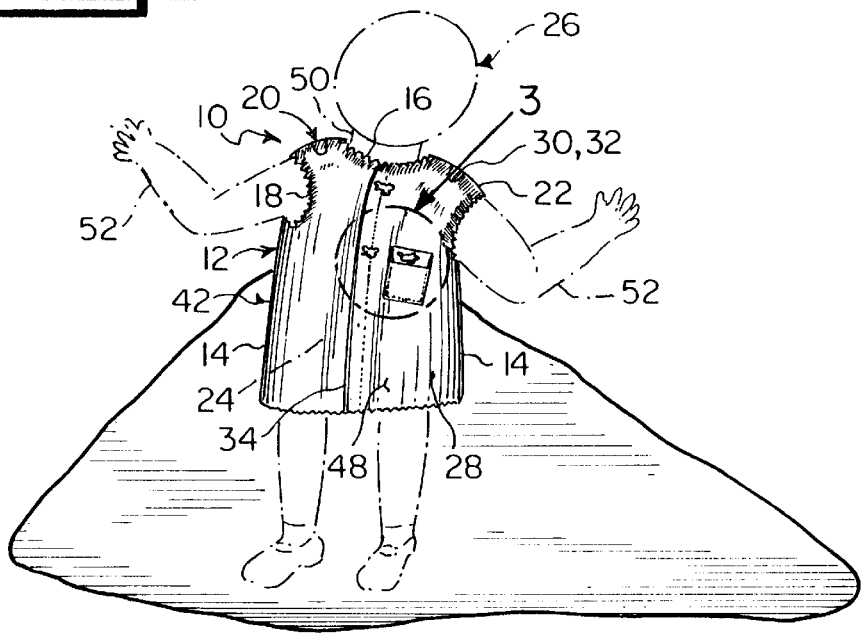
Fig. 2
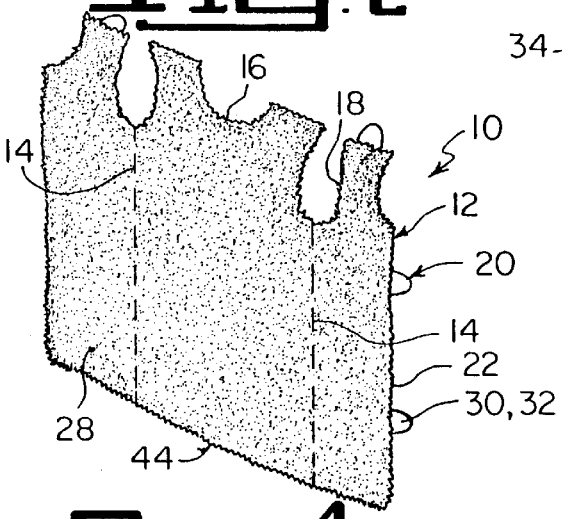
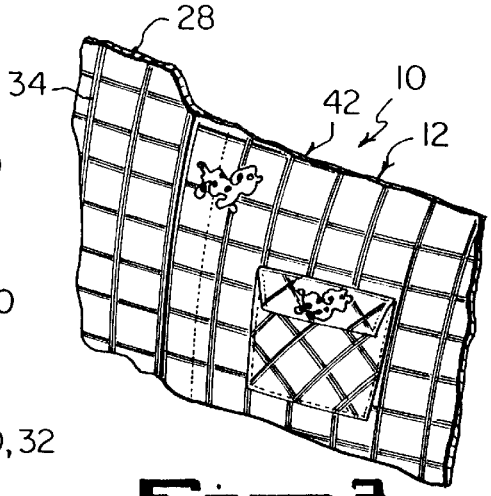
Fig. 3
Fig. 4
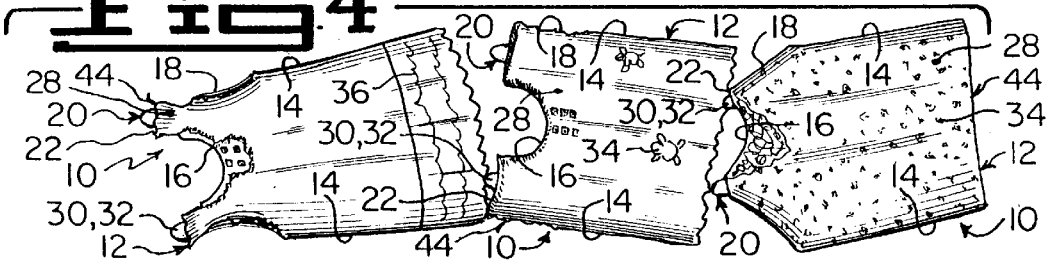

DISPOSABLE INFANT GARMENT

BACKGROUND OF THE INVENTION

1 . Field of the Invention

The instant invention relates generally to articles of baby clothing and more specifically it relates to a disposable infant garment. The disposable infant garment is made out of a durable breathable paper material, to free a mother from worrying, by allowing the mother to wipe clean the infant with the garment before disposal of the garment.

2 . Description of the Prior Art

Numerous articles of baby clothing have been provided in prior art that are adapted to cover human baby bodies with various types of wearing apparel. While these units may be suitable for the particular purpose to which they address, they would not be as suitable for the purposes of the present invention as heretofore described.

SUMMARY OF THE INVENTION

A primary object of the present invention is to provide a disposable infant garment that will overcome the shortcomings of the prior art devices.

Another object is to provide a disposable infant garment that is made out of a durable breathable paper material, so as to free a mother from worrying, by allowing the mother to wipe clean the infant with the garment before disposal of the garment.

An additional object is to provide a disposable infant garment that will include a pattern for paper clothes with all designs and trimming to be imprinted onto the durable breathable paper material, while fastening tapes and elastic shirring will complete the garment.

A further object is to provide a disposable infant garment that is simple and easy to use.

A still further object is to provide a disposable infant garment that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a perspective view of a male infant shown in phantom, wearing the present invention being a male infant shirt.

FIG. 2 is an unfolded perspective view of the present invention, being a female infant blouse.

FIG. 3 is an enlarged perspective view of an area of the male infant shirt, as indicated by arrow 3 in FIG. 1.

FIG. 4 is a plan view of the present invention being three more female infant blouses.

Similar reference characters denote corresponding features consistently throughout the attached drawings.

DESCRIPTION OF THE PREFERRED EMBODIMENTS

Figure 5:
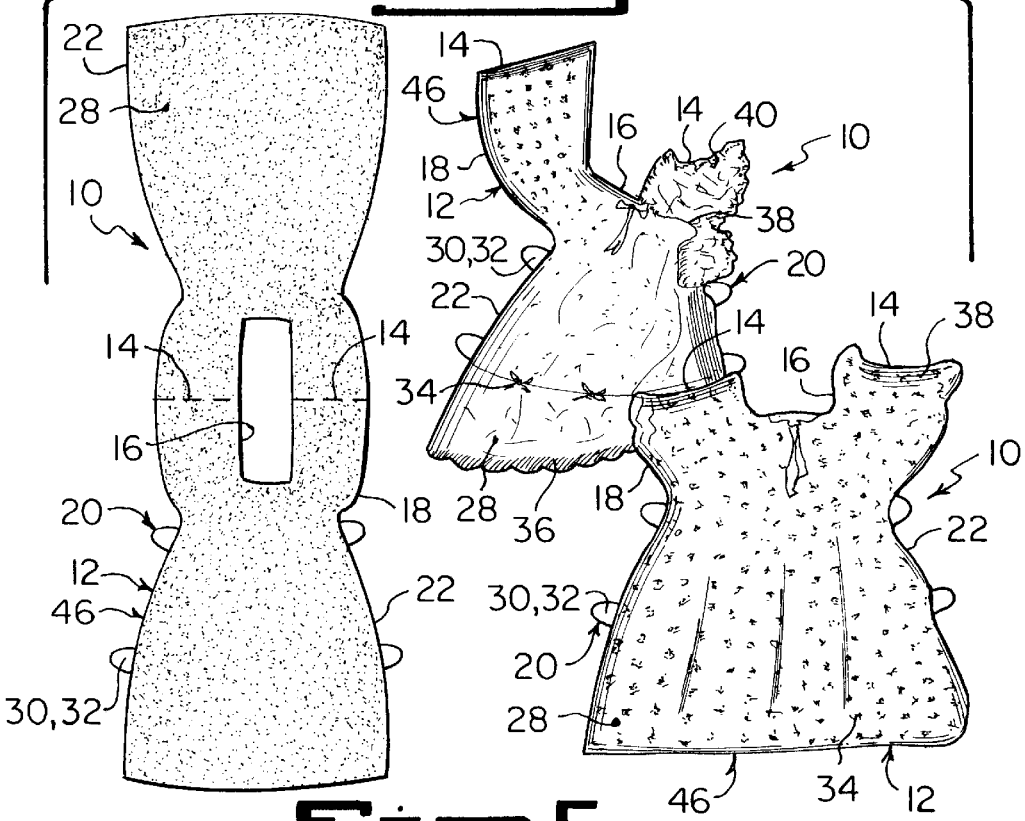
FIG. 5 is a plan view of the present invention being three female infant dresses, one of which is unfolded.

Turning now descriptively to the drawings, in which similar reference characters denote similar elements throughout the several views, FIGS. 1 through 6 illustrate the present invention being a disposable infant garment 10. With regard to the reference numerals used, the following numbering is used throughout the various drawing figures.

10 disposable infant garment
12 one piece body pattern portion of 10
14 fold line on 12
16 neck opening on 12
18 armhole on 12
20 fastening facility of 10
22 abutting edge of 12
24 torso of 26
26 infant
28 durable breathable paper material for 12
30 adhesive tape tab of 20
32 VELCRO tape tab of 20
34 design imprinted on 12
36 trimming imprinted on 12
38 elastic shirring sewn in 12
40 ruffle on 12
42 male infant shirt for 12
44 female infant blouse for 12
46 female infant dress for 12
48 waterproofing ingredient impregnated in 12
50 neck of 26
52 arm of 26

The disposable infant garment 10 comprises a one piece body pattern portion 12 having fold lines 14, a neck opening 16 and a pair of armholes 18. A facility 20 is for fastening abutting edges 22 of the one piece body pattern portion 12 together, after being placed onto a torso 24 of an infant 26 and folded into position along the fold lines 14.

The one piece body pattern portion 12 is fabricated out of a durable breathable paper material 28. The fastening facility 20 can consist of a plurality of adhesive tape tabs 30, attached to one of the abutting edges 22 of the one piece body pattern portion 12. When the one piece body pattern portion 12 is folded into position along the fold lines 14, the adhesive tape tabs 30 will hold the abutting edges 22 together.

The fastening facility 20 can also consist of a plurality of VELCRO, and brand name for hook and loop fasteners tape tabs 32, attached to the abutting edges 22 of the one piece body pattern portion 12. When the one piece body pattern portion 12 is folded into position along the fold lines 14, the VELCRO tape tabs 32 will mate to hold the abutting edges 22 together.

The one piece body pattern portion 12 can include designs 34 imprinted thereon to enhance the appearance thereof. The one piece body pattern portion 12 can include trimming 36 imprinted thereon to enhance the appearance thereof. The one piece body pattern portion 12, can also include elastic shirring 38 sewn therein, to form ruffles 40 into the one piece body pattern portion 12.

Figure 6:
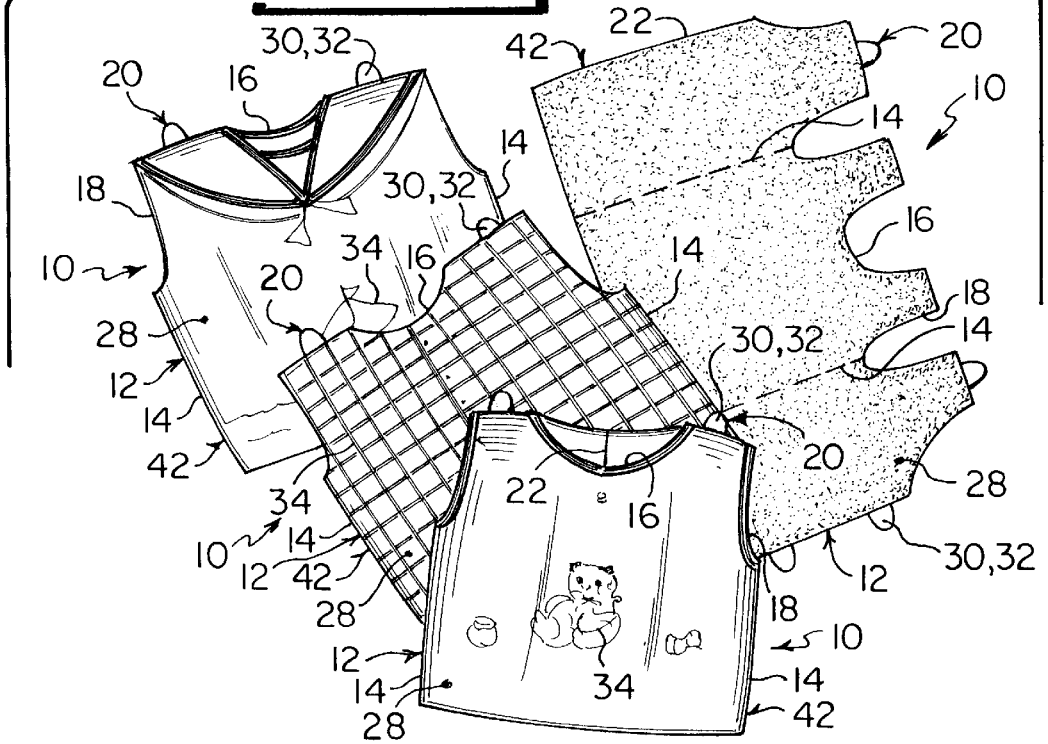
FIG. 6 is a plan view of the present invention being four male infant shirts, one of which is unfolded.

The one piece body pattern portion 12 can be shaped as a male infant shirt 42, as shown in FIGS. 1, 3 and 6. The one piece body pattern portion 12 can be shaped as a female infant blouse 44, as shown in FIGS. 2 and 4. The one piece body pattern portion 12 can also be shaped as a female infant dress 46, as shown in FIG. 5. The one piece body pattern portion 12, as shown in FIG. 1, can be impregnated with a waterproofing ingredient 48, so as to keep the torso 24 of the infant 26 dry.

OPERATION OF THE INVENTION

To use the disposable infant garment 10, the following steps should be taken:

1. Place the one piece body pattern portion 12 on the torso 24 of the infant 26.

2. Make sure that the neck 50 of the infant 26 extends out of the neck opening 16, while the arms 52 of the infant 26 extend out of the armholes 18 of the one piece body pattern portion 12, as shown in FIG. 1.

3. Fold the one piece body pattern portion 12 along the fold lines 14.

4. Secure the abutting edges 22 with either the adhesive tape tabs 30 or the VELCRO tape tabs 32.

5. Separate the abutting edges 22 by releasing the adhesive tape tabs 30 or the VELCRO tape tabs 32 after the infant 26 has worn the one piece body pattern portion 12 for a length of time and has soiled it.

6. Unfold the one piece body pattern portion 12 along the fold lines 14.

7. Remove the one piece body pattern portion 12 from the torso 24 of the infant 26.

8. Dispose of the one piece body pattern portion 12.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A disposable infant garment comprising:

a) a one piece body pattern portion made from a breathable paper material having fold lines, a neck opening and a pair of armholes, said one piece body portion being sized and shaped for use on an infant, said fold lines extending from a bottom edge of said one piece body pattern portion to said armholes;

b) means for fastening abutting edges of said one piece body pattern portion together after being placed onto a torso of an infant and folded into position along fold lines;

c) said fastening means including a plurality of tabs attached to abutting edges of said one piece body pattern portion, each tab overlapping an abutting edge of said one piece body pattern portion and having means for holding the abutting edges together; and d) said one piece body pattern portion being impregnated with a waterproofing ingredient to keep the torso of the infant dry.

2. A disposable infant garment as recited in claim 1, wherein said one piece body pattern portion includes designs imprinted thereon to enhance the appearance thereof.

3. A disposable infant garment as recited in 1, wherein said one piece body pattern portion includes trimming imprinted thereon to enhance the appearance thereof.

4. A disposable infant garment as recited in claim 1, wherein said one piece body pattern portion includes elastic shirring sewn therein, to form ruffles into said one piece body pattern portion.

5. A disposable infant garment as recited in claim 1, wherein said one piece body pattern portion is shaped as a male infant shirt.

6. A disposable infant garment as recited in claim 1, wherein said one piece body pattern portion is shaped as a female infant blouse.

7. A disposable infant garment as recited in claim 1, wherein said one piece body pattern portion is shaped as a female infant dress.

* * * * *